US006196215B1

(12) United States Patent
Chandaria

(10) Patent No.: US 6,196,215 B1
(45) Date of Patent: Mar. 6, 2001

(54) FIRELOG WITH GRATE

(75) Inventor: Ashok Velji Chandaria, Nairobi (KE)

(73) Assignee: Conros Corporation, Ontario (CA)

( * ) Notice: Subject to any disclaimer, the term of this patent is extended or adjusted under 35 U.S.C. 154(b) by 0 days.

(21) Appl. No.: 09/226,463

(22) Filed: Jan. 6, 1999

(51) Int. Cl.[7] ..... F24B 1/193

(52) U.S. Cl. ..... 126/540; 126/152 R; 126/298; 44/530; 44/540

(58) Field of Search ..... 126/298, 152 B, 126/152 R, 540, 541, 153; 44/576, 541, 590, 606, 530, 535, 520, 521, 522

(56) References Cited

U.S. PATENT DOCUMENTS 3,771,511 * 11/1973 Dahlquist ..... 126/540
4,040,796 * 8/1977 Vincent et al. ..... 126/530
4,305,375 * 12/1981 George ..... 126/540
4,862,871 * 9/1989 Sieberth ..... 126/540
5,112,365 * 5/1992 MacIsaac et al. ..... 44/576
5,842,465 * 12/1998 Cassidy ..... 126/540
5,858,032 * 1/1999 Hardy et al. ..... 44/522

* cited by examiner

*Primary Examiner*—Ira S. Lazarus
*Assistant Examiner*—Josiah C. Cocks
(74) *Attorney, Agent, or Firm*—Sand & Sebolt

(57) ABSTRACT

A firelog and grate system wherein the firelog is supported by the grate in a generally upright orientation includes a bed and at least a first support member. The firelog contains at least a first support surface. The first support surface of the firelog rests against the first support member of the grate, thereby retaining the firelog from movement in the downward direction, the frontward and rearward directions, and the left and right directions. The grate may contain multiple support members to support multiple firelogs for simultaneous burning. The support members can constitute plates, pins, or support lugs. In the plate configuration, the support member inhibits the burning of the firelog in the rearward direction, i.e., the direction which cannot be observed, thereby producing less unnecessary heat. Thus, the firelog and grate system of the present invention provides a fire that is more aesthetically pleasing, provides for greater safety, and produces less heat than other firelog and grate systems presently known and understood in the relevant art.

29 Claims, 8 Drawing Sheets

FIRELOG WITH GRATE

BACKGROUND OF THE INVENTION

1. Technical Field

The invention relates generally to a firelog and a fireplace grate. More particularly, the invention relates to a firelog which is held by a fireplace grate in a substantially upright orientation. Specifically, the invention relates to an elongated artificial firelog having a support surface and a fireplace grate having a support member that contacts the support surface to carry the artificial firelog in a substantially upright orientation.

2. Background of the Invention

Various types of artificial firelogs have been developed and are well understood in the relevant art. These artificial firelogs are typically intended for use in domestic fireplaces to produce aesthetically pleasing fires. The principal and by far most common use is in a domestic fireplace to provide an attractive fire closely simulating a natural wood fire without the work and mess ordinarily associated with wood-fueled fires.

Such artificial firelogs are typically formed of a particulate combustible material such as sawdust or coal particles which is combined with a binder material such as paraffin, with the mixture being compressed into a predetermined and desirable shape. Other materials may, of course, be used and are well known and understood in the relevant art. Moreover, these artificial firelogs may contain various additives to enhance burning or to produce colored flames, thereby enhancing the attractiveness of the resultant fire.

Artificial firelogs are typically manufactured in a continuous extrusion process wherein the particulate combustible material is combined with an appropriate binder and other additives, with the mixture being compressed within an extrusion bore. The extruded stream exiting the bore is then typically cut to predetermined sizes and placed into protective wrappers. Other processes for manufacturing artificial firelogs are likewise known and understood in the relevant art.

These artificial firelogs are typically placed by the consumer onto a fireplace grate for burning thereon. A fireplace grate is a body which supports burning members above the ground and allows for enhanced airflow underneath the burning members to promote combustion thereof. Such fireplace grates typically contain a horizontal surface upon which the fire is built, with the horizontal surface having a plurality of holes or elongated channels to allow the air to flow therethrough. Fireplace grates are typically manufactured of a material suited to withstand the heat of a fire such as steel or cast iron.

Inasmuch as such artificial firelogs are intended primarily to produce an aesthetically pleasing fire, new methods of utilizing artificial firelogs to produce a more attractive or aesthetically pleasing fire are continually sought. Some of the methods employed include the formation of artificial firelogs in new and unique shapes intended to more closely simulate a real wood fire. Other methods have involved the use of multiple artificial firelogs stacked one upon another to produce a similar effect.

Such efforts to improve the aesthetic qualities of fires made with artificial firelogs have not, however, been without problems. The use of multiple artificial firelogs creates a significant amount of heat, which can potentially result in damage to the fireplace grate, flues, and dampers. Moreover, excess heat can make an otherwise attractive fire undesirable. Additionally, many artificial firelogs are designed to burn individually, and the use of such firelogs in groups may result in improper burning of the firelogs.

The use of multiple stacked firelogs can additionally result in instability of the fire due to the consumption of the firelogs during the burning process, with the result that partially burned firelogs can tend to collapse and fall amongst themselves, presenting in an unsafe situation which should be avoided. While fireplace grates are often designed with one or more upturned edges intended to inhibit burning members from rolling off the grate, such upturned edges are not always effective against the rolling of large, heavy, burning artificial firelogs.

When conventional artificial firelogs known in the art are burned, combustion occurs on all externally exposed surfaces. When a portion of the burning firelog is obstructed from view, such as the rear of the firelog, that portion of the firelog burns needlessly as it cannot be observed. Moreover, that portion of the firelog needlessly generates heat.

The need thus exists for a firelog and/or fireplace grate that enhances the aesthetic beauty of a fire, that is safe to use, and that generates little or no unnecessary heat.

SUMMARY OF THE INVENTION

Objectives of the invention include providing an improved fireplace grate.

Another objective of the invention is to provide an improved artificial firelog.

Another objective of the invention is to provide an improved artifical firelog and grate system.

Another objective of the invention is to provide a fireplace grate that holds artificial firelogs in a substantially upright orientation.

Another objective of the invention is to provide a fireplace grate that promotes economical burning of artificial firelogs.

Another objective of the invention is to provide a fireplace grate that holds artificial firelogs in such a way to produce an aesthetically pleasing fire.

Another objective of the invention is to provide a fireplace grate that enhances the safety in burning a fire fueled by artificial firelogs.

Another objective of the invention is to provide a fireplace grate that permits multiple firelogs to be burned without generating significant unnecessary heat.

An additional objective of the invention is to provide a fireplace grate that can hold artificial firelogs in various positions.

An additional objective of the invention is to provide an artificial firelog having at least a first support surface by which the firelog can be held in a substantially upright orientation.

These and other objectives and advantages of the invention are obtained by the improved fireplace grate, the general nature of which may be stated as including a bed and at least a first support member connected to and extending upwardly from and extending upwardly from the bed.

Still other objectives and advantages of the invention are obtained from the improved firelog, the general nature of which may be stated as having an elongated body having a length and at least a first support system and formed of a particulate material and a binder material, with the at least first support surface of the body adapted to being carried by at least a first support member with the length of the body oriented substantially upright.

Yet other objectives and advantages of the invention are obtained by the improved firelog and fireplace grate system, the general nature of which may be stated as a grate comprising a bed and at least a first support member connected thereto, a firelog comprising an elongated body having a length and at least a first support surface and formed of a particulate material and a binder material, the at least first support surface of the body being carried by the at least first support member with the length of the body being oriented substantially upright, and the firelog extending substantially upward from the bed.

BRIEF DESCRIPTION OF THE DRAWINGS

The preferred embodiments of the invention, illustrative of the best modes in which applicant has contemplated applying the principles of the invention, are set forth in the following description and are shown in the drawings and are particularly and distinctly pointed out and set forth in the appended claims.

Similar numerals refer to similar parts throughout the specification.

DESCRIPTION OF THE PREFERRED EMBODIMENTS

Figure 1:
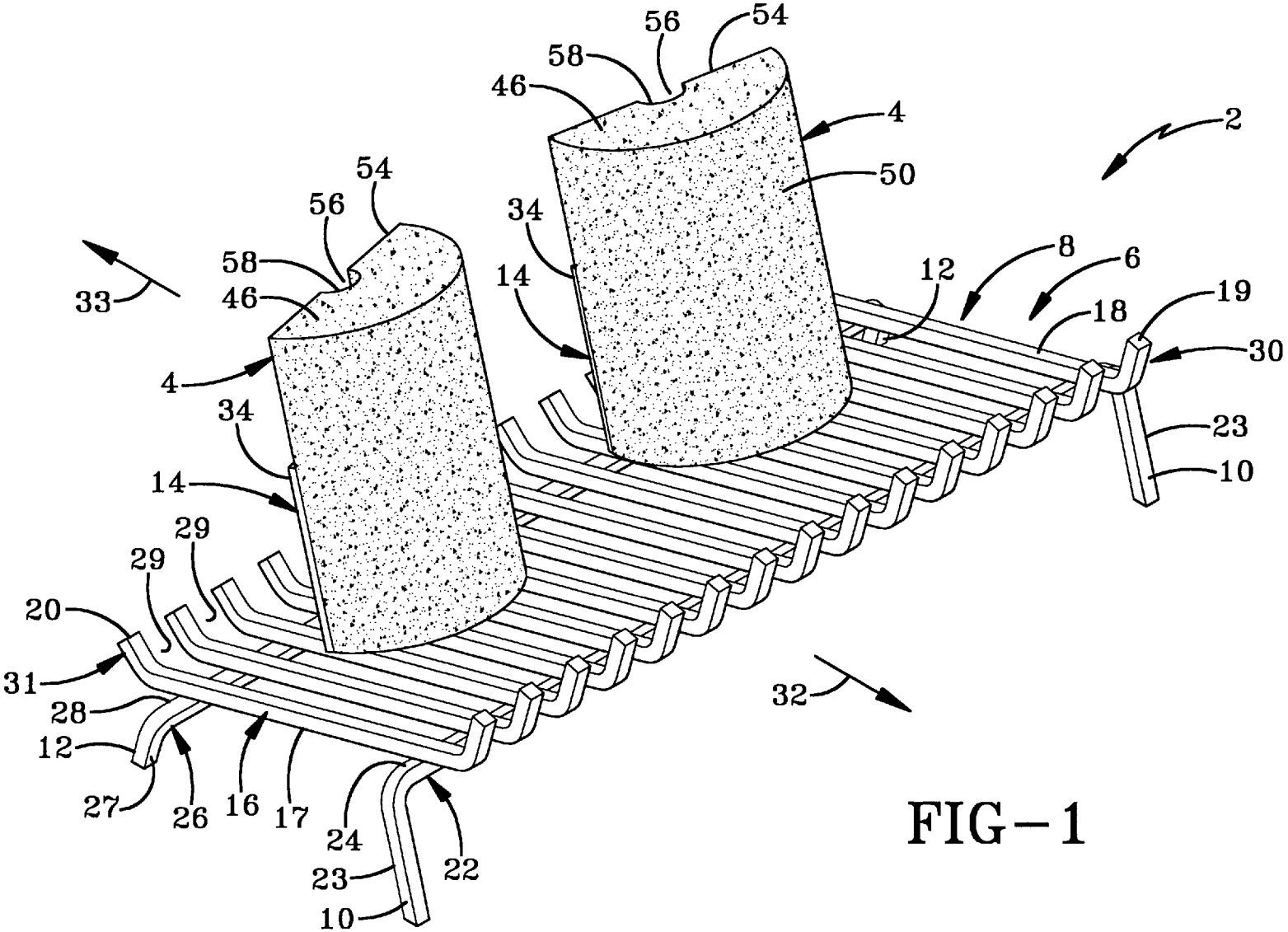
FIG. 1 is a perspective view of a first embodiment of the firelog and grate system of the present invention.

A first embodiment of the improved firelog and grate system of the present invention is indicated generally by the numeral 2 and is particularly shown in FIGS. 1–7. System 2 includes at least a first firelog 4 and a grate 6. Each firelog 4 is carried by grate 6, as is best shown in FIG. 1. Grate 6 is preferably made of a material suitable to withstand the heat of an ordinary fire, such as steel or cast iron, although other materials may be used without departing from the spirit of the present invention.

Grate 6 includes a bed 8, a pair of front legs 10, a pair of rear legs 12, and at least a first support plate 14. While bed 8, front legs 10, rear legs 12, and support plates 14 of grate 6 may be fixedly attached to one another, these members may alternatively be moveably or detachably attached to one another without departing from the spirit of the present invention.

Bed 8 includes a plurality of bed bars 16, a front transverse bar 22, and a rear transverse bar 26. Bed bars 16 are a plurality of parallel spaced apart elongated members, which, in the preferred embodiments, are of a rectangular cross-section, each bed bar 16 having a lower surface 17, an upper surface 18, a front end 19, and a rear end 20.

Front transverse bar 22 is, in the preferred embodiments, an elongated member of a rectangular cross-section and includes a pair of ends 23 and a top surface 24. Rear transverse bar 26 is, in the preferred embodiments, an elongated member of a rectangular cross-section and includes a pair of ends 27 and a top edge 28.

Lower surfaces 17 of bed bars 16 are each attached to both top surface 24 of front transverse bar 22 and top edge 28 of rear transverse bar 26. In the preferred embodiments, bed bars 16 are each parallel with one another, and front transverse bar 22 is parallel with rear transverse bar 26, with each of bed bars 16 being perpendicular to both front and rear transverse bars 22 and 26. Nevertheless, inasmuch as the design of grate 6 is largely a matter of aesthetics, the parallel, perpendicular, and/or oblique relationships between bed bars 16, front transverse bar 22, and rear transverse bar 26 can, of course, be varied to suit a particular need or taste without departing from the spirit of the present invention.

The space between bed bars 16 define a plurality of voids 29 therebetween that permit air to flow through bed 8 and promote the combustion of firelogs 4. Thus, upper surfaces 18 of bed bars 16 create a substantially flat surface interrupted by voids 29. Front ends 19 of bed bars 16 are preferably turned upward to form a front lip 30 on bed 8. Likewise, it is preferred that rear ends 20 are turned upward to create a rear lip 31 on bed 8. Front lip 30 and rear lip 31 are intended to enhance the safety of maintaining a fire on grate 6 by inhibiting burning embers and the like from rolling off of bed 8 and onto the floor below.

Figure 4:
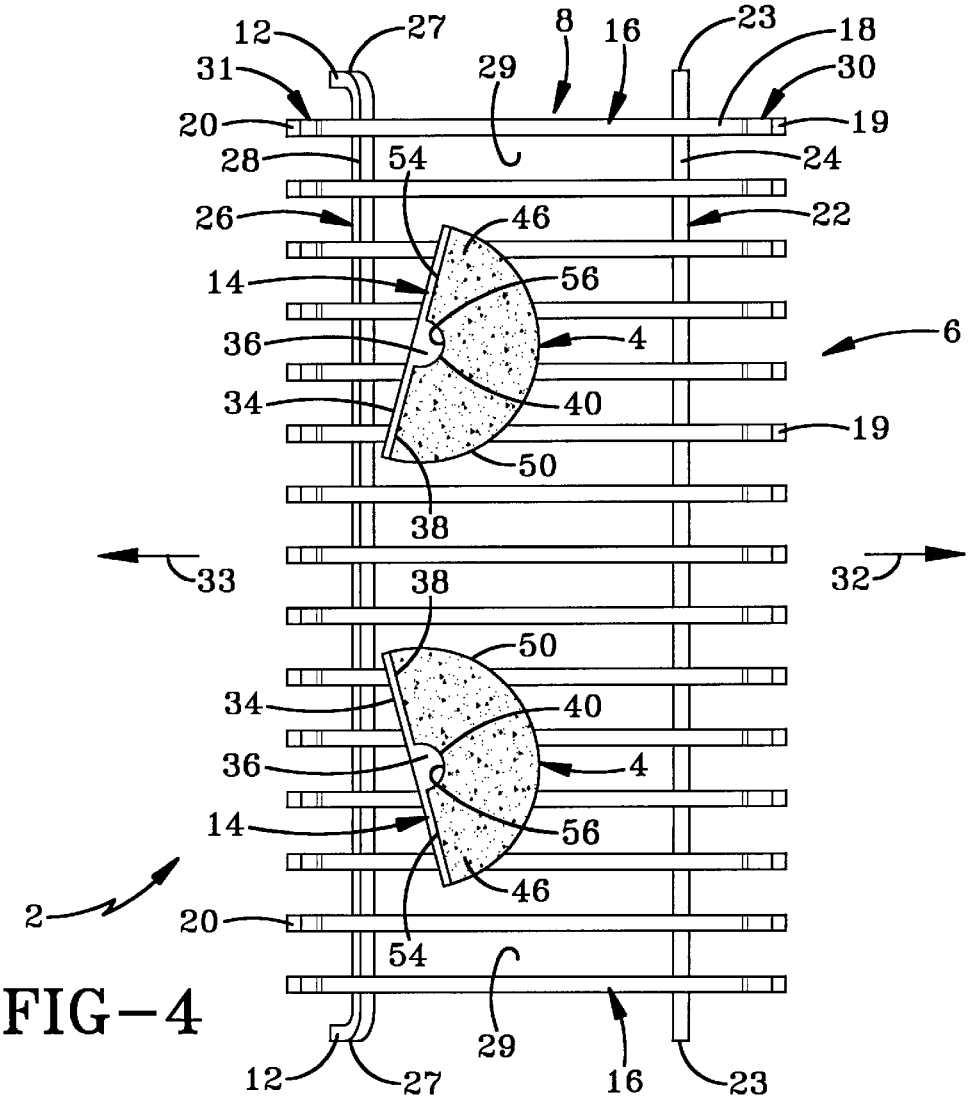
FIG. 4 is a view of the first embodiment of the firelog and grate system of the present invention taken along line 4—4 of FIG. 3.

As can be best seen in FIG. 4, front transverse bar 22 and front lip 30 are in a forward direction 32 with respect to grate 6. Similarly, rear transverse bar 26 and rear lip 31 are in a rearward direction 33 with respect to grate 6. It is anticipated that system 6 will ordinarily be observed from the frontward direction 32 inasmuch as rearward direction 33 will likely face into a fireplace alcove, and thus be obstructed from view.

In the preferred embodiments, ends 23 of front transverse bar 22 angle downward to form front legs 10. Similarly, ends 27 of rear transverse bar 26 angle downward to form rear legs 12. As can best be seen in FIG. 3, front legs 10 are substantially perpendicular to bed 8, while rear legs 12 are oblique to bed 8. In the preferred embodiment of the invention, bed 8 is not horizontal when grate 6 is placed on a horizontal surface. Inasmuch as bed 8 of system 2 is usually not horizontal, when grate 6 rests on a horizontal surface, front legs 10 extend frontwardly from their connection with bed 8, and rear legs 12 extend rearwardly from their attachment with bed 8 to enhance the stability of grate 6.

It should be understood that bed bars 16, front transverse bar 22, and rear transverse bar 26 are shown in the accompanying figures in an exemplary format. As such, their particular arrangement can be changed without departing from the spirit of the present invention. Likewise, grate 6 may be formed out of a single piece of material, such as through stamping, forging, or casting, without departing from the spirit of the present invention. As such, bed bars 16, front transverse bar 22, and rear transverse bar 26 can be secured to one another by any attachment system such as welding or bolting, or by formation of grate 6 out of a single piece of material as indicated hereinbefore.

Figure 2:
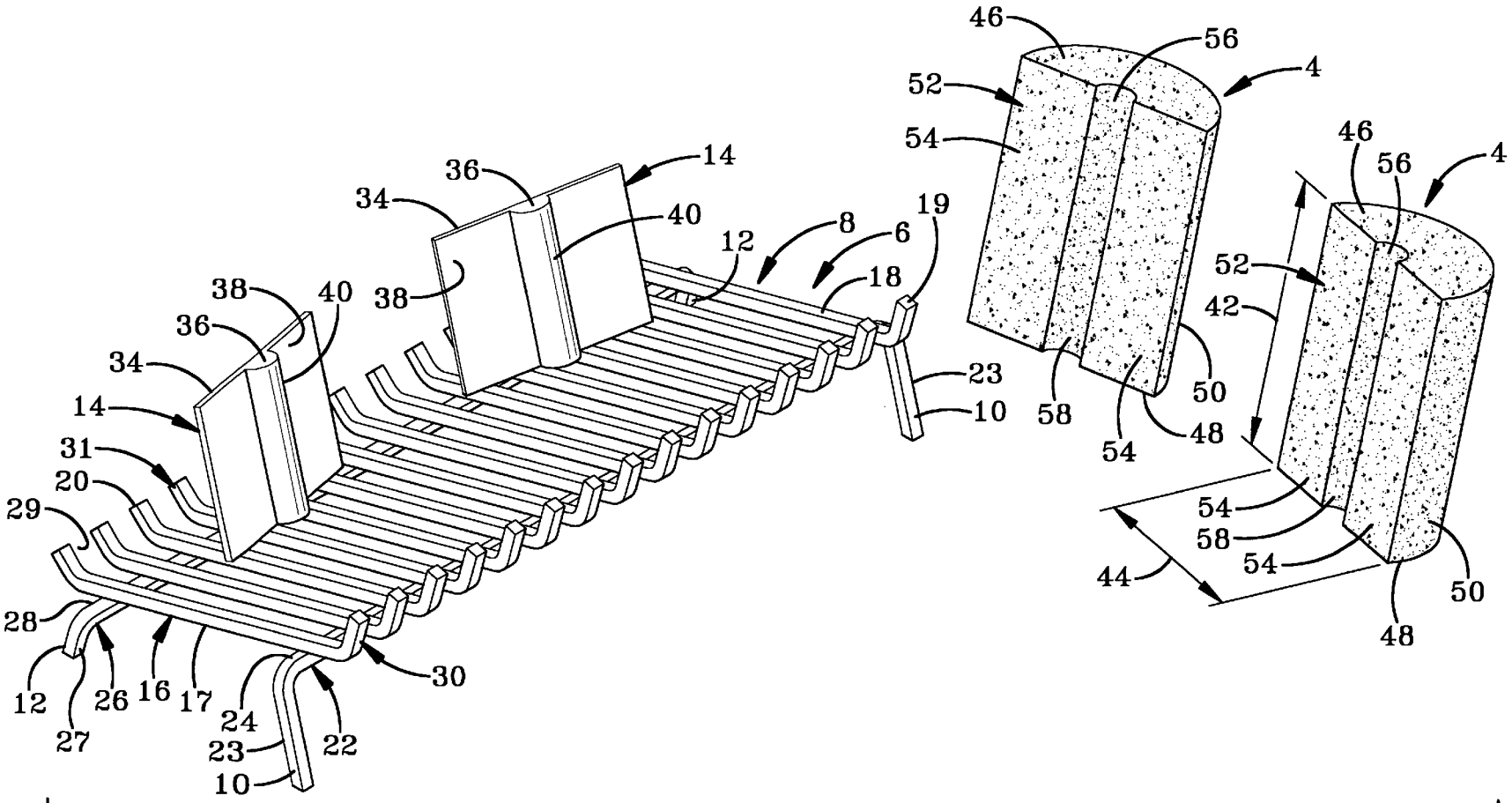
FIG. 2 is an exploded perspective view of the first embodiment of the firelog and grate system of the present invention.

In accordance with the objectives of the present invention, at least one support plate 14 is attached to one or more upper surfaces 18 of bed bars 16, with each support plate 14 extending generally upwardly therefrom. Support plates 14 include a backing plate 34 and a rib 36. In the preferred embodiment, backing plate 34 is a substantially planar piece of material having a flat forward surface 38. As shown in FIG. 2, rib 36 is a protrusion of partial cylindrical section extending outwardly from forward surface 38 to form a curved surface 40 thereon. Rib 36 is substantially centered on backing plate 34 and extends along substantially the length of backing plate 34. In accordance with the objectives of the present invention, both backing plate 34 and rib 36 constitute support members for supporting a firelog thereon.

Figure 6:
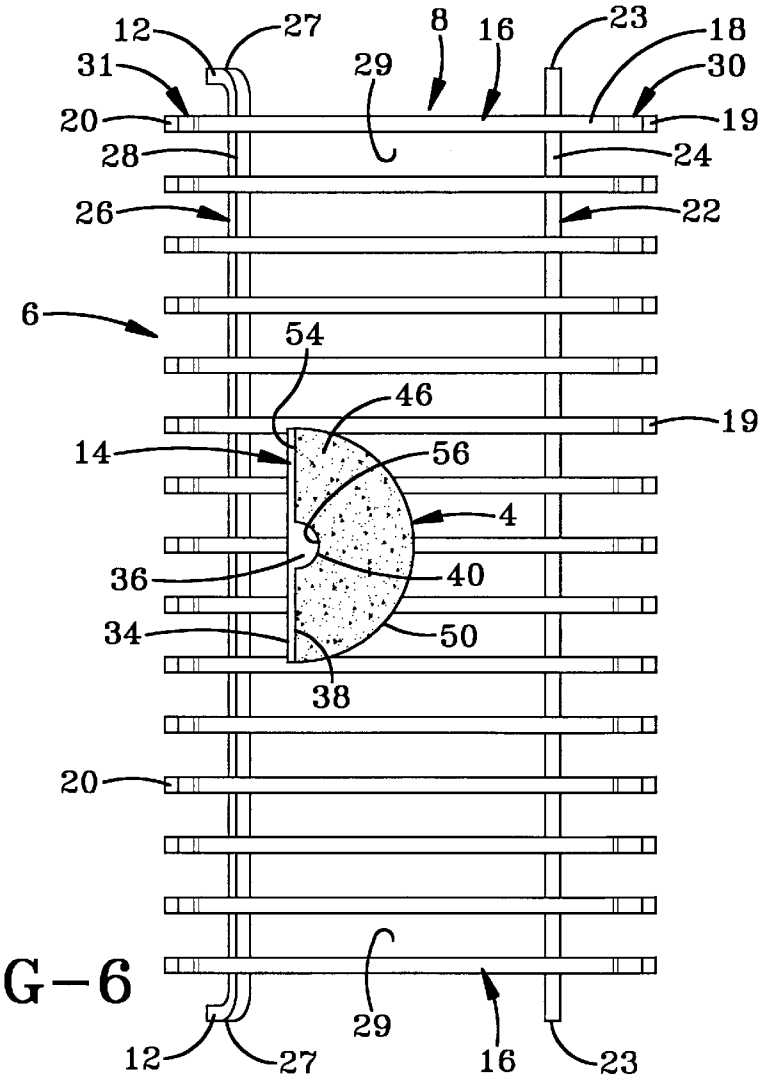
FIG. 6 is a view similar to FIG. 4 of the first embodiment of the firelog and grate system of the present invention using only a single support plate.
Figure 5:
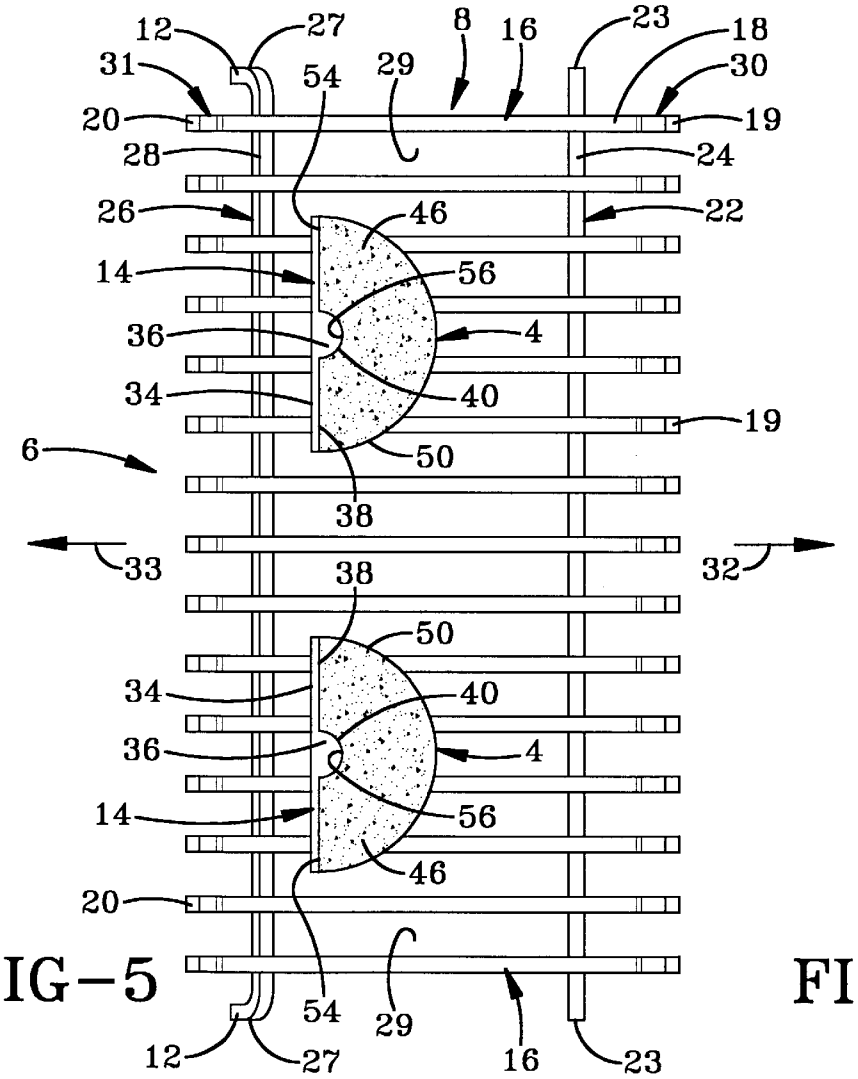
FIG. 5 is a view similar to FIG. 4 of the first embodiment of the firelog and grate system of the present invention showing the support plates in different positions.
Figure 7:
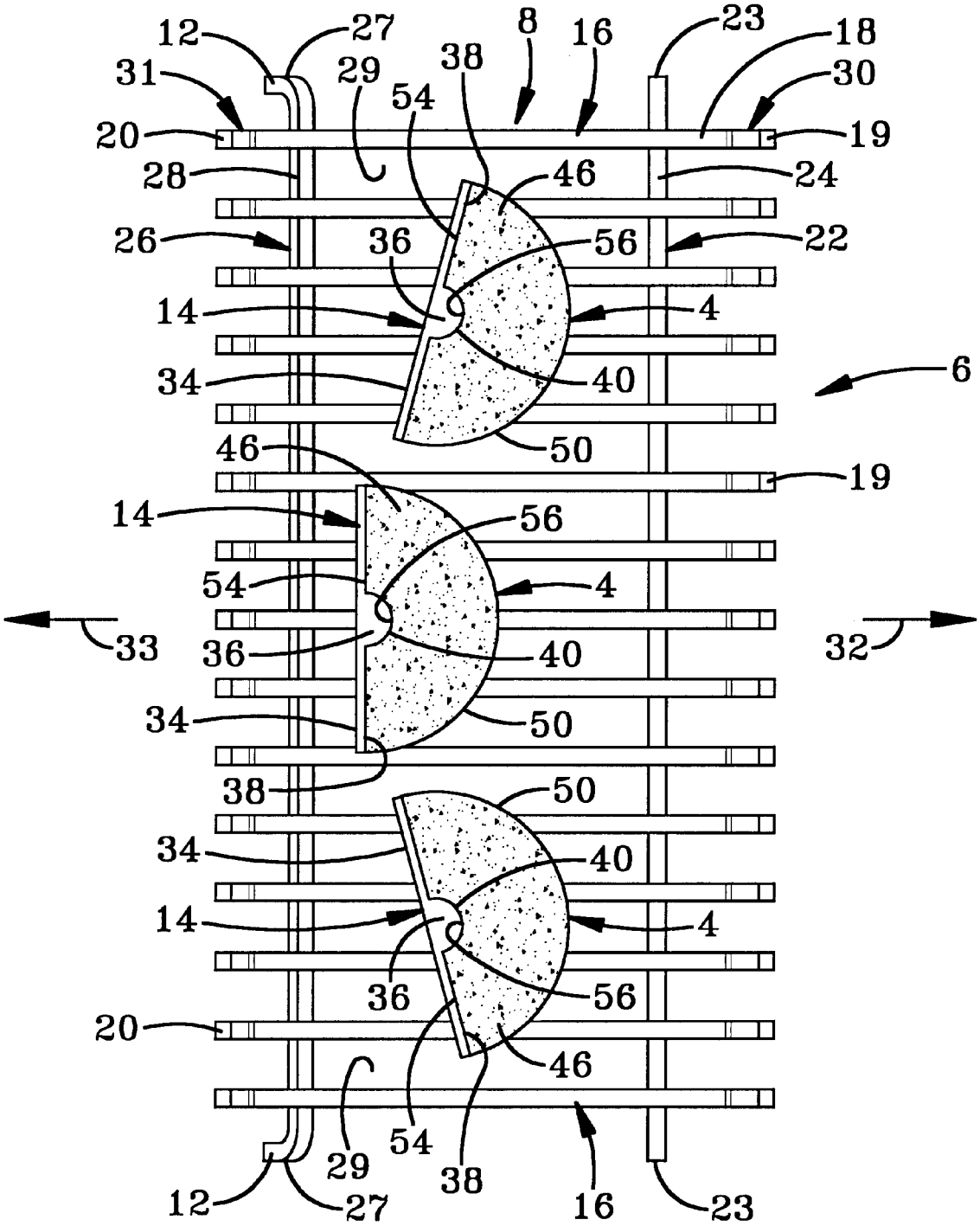
FIG. 7 is a view similar to FIG. 4 of the first embodiment of the firelog and grate system of the present invention using three support plates.
Figure 8:
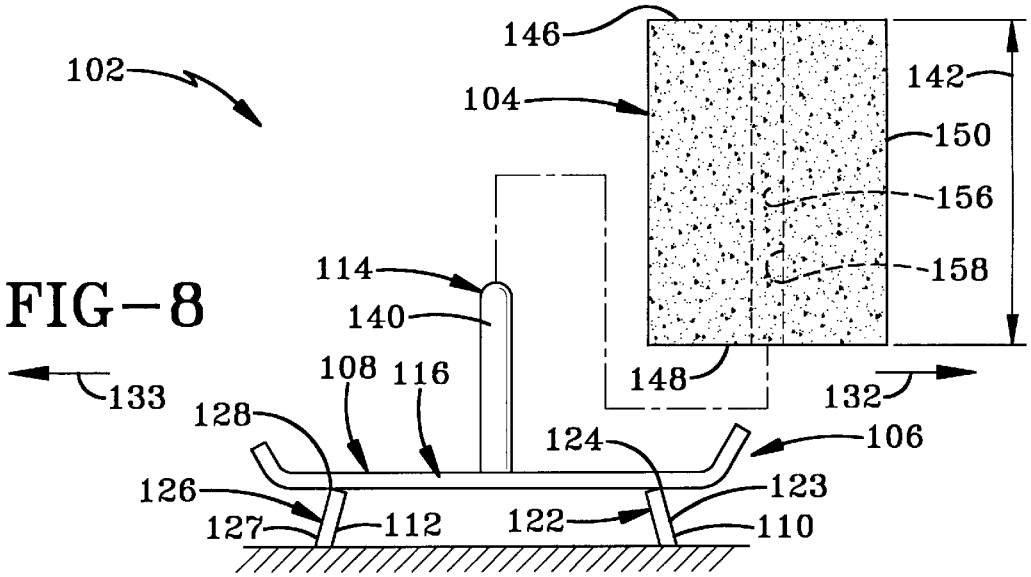
FIG. 8 is an exploded side elevational view of a second embodiment of the firelog and grate system of the present invention.
Figure 9:
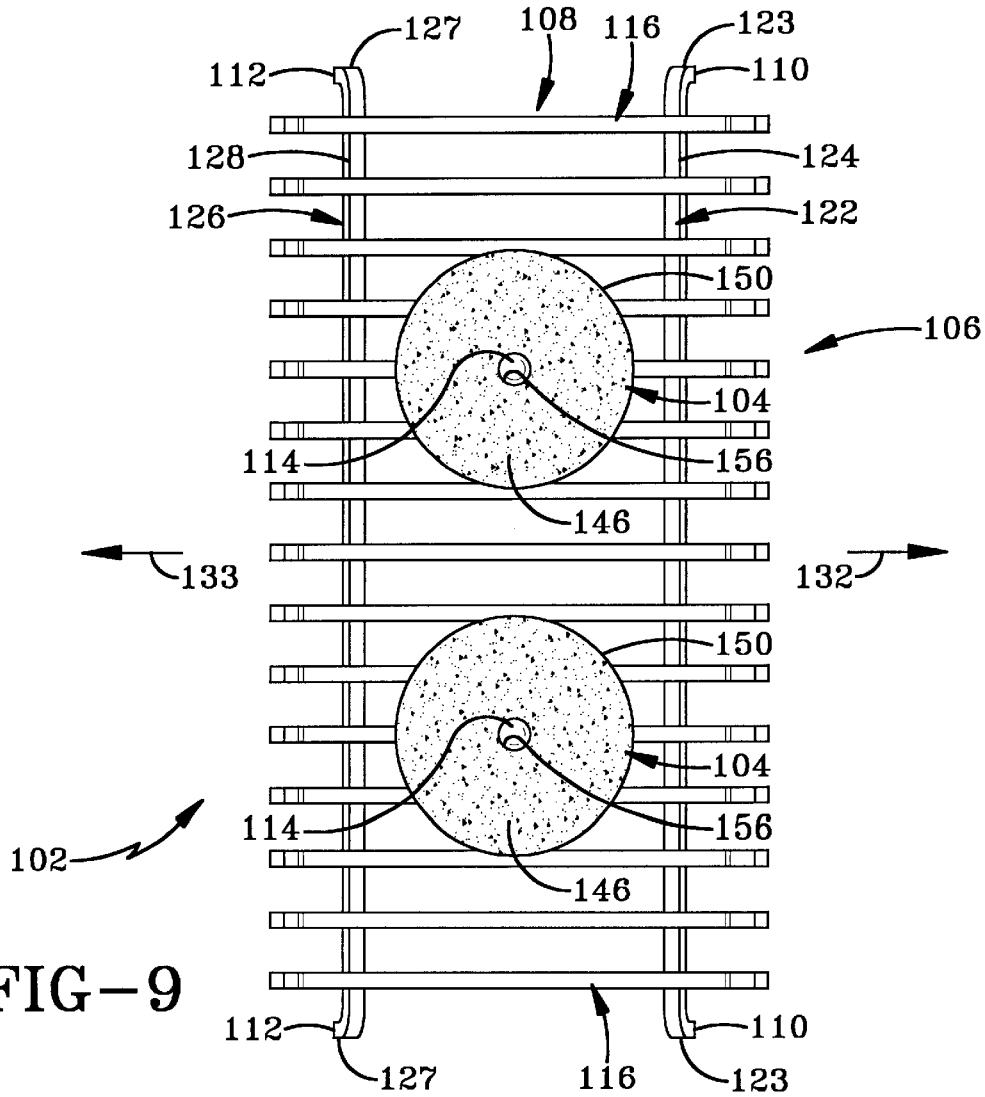
FIG. 9 is a plan view of the second embodiment of the firelog and grate system of the present invention.
Figure 11:
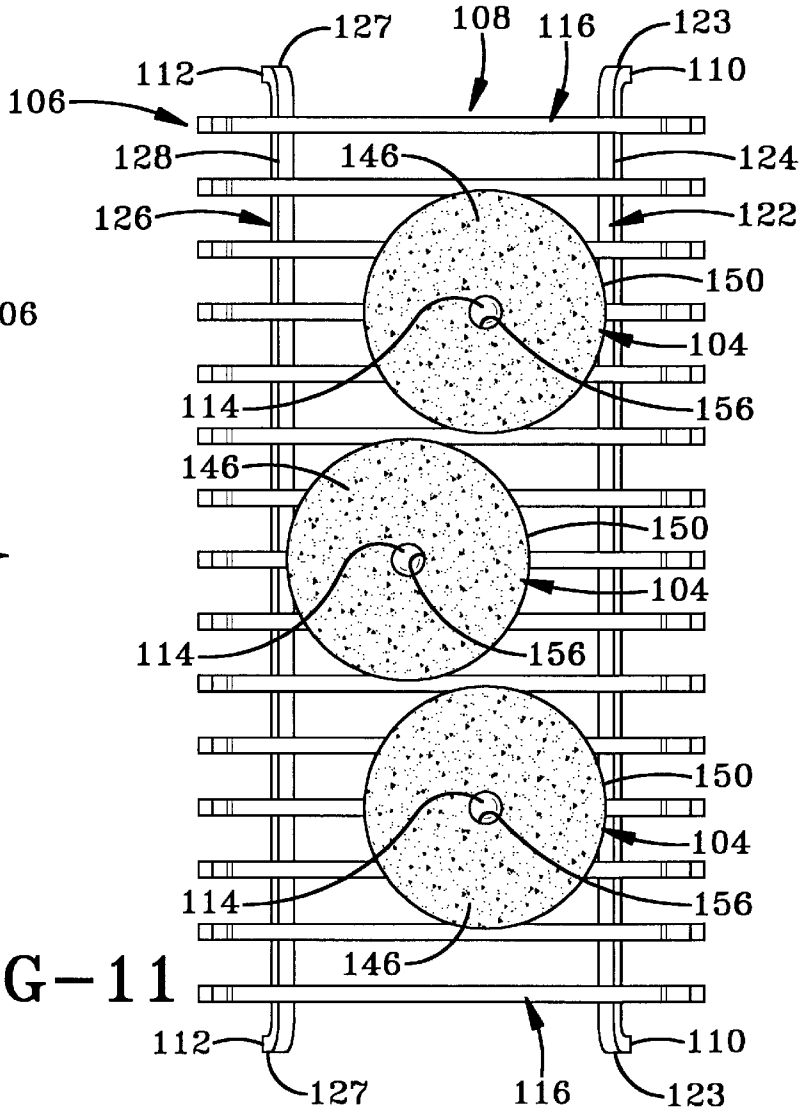
FIG. 11 is a plan view of the second embodiment of the firelog and grate system of the present invention using three support pins.
Figure 10:
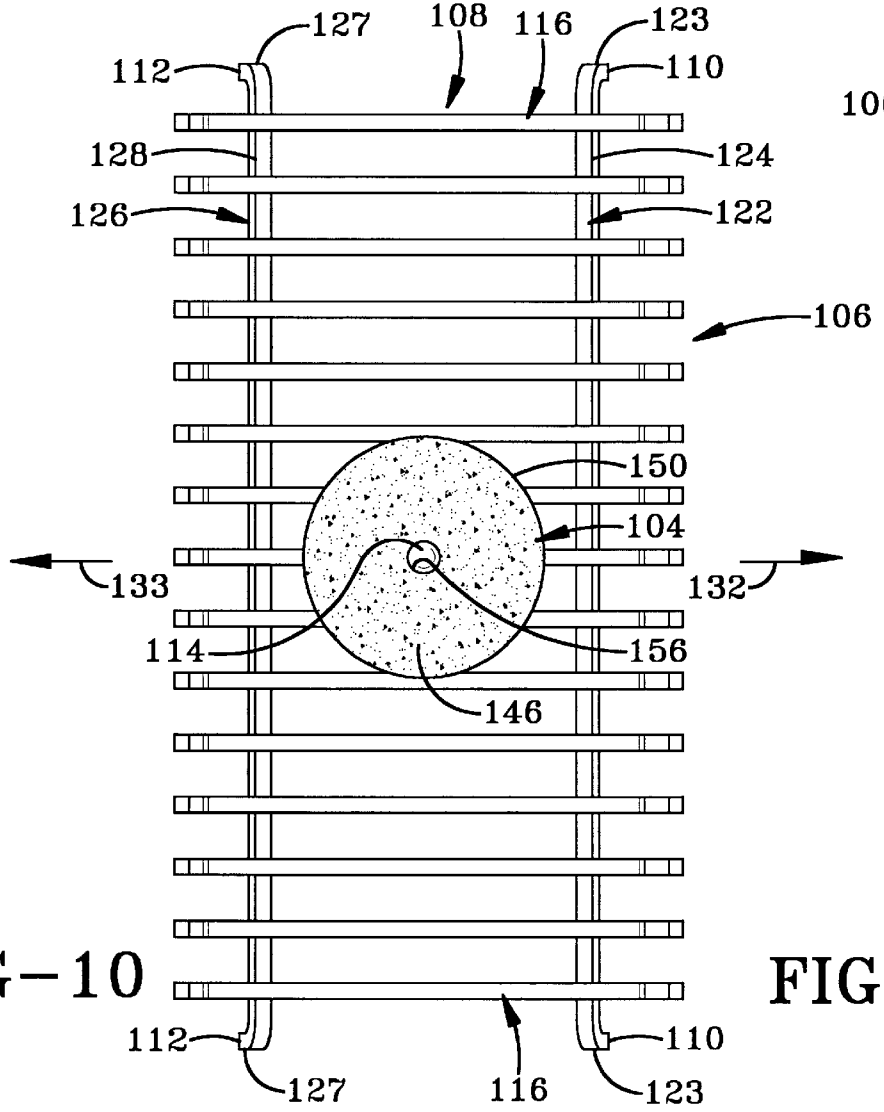
FIG. 10 is a plan view of the second embodiment of the firelog and grate system of the present invention using only a single support pin.

In accordance with the objectives of the invention, forward surface 38 may face the forward direction 32 as is indicated in FIGS. 5–6, or may be oblique thereto as is indicated in FIGS. 1–4 and 7. Moreover, as is indicated in FIGS. 5–7, grate 6 may contain one or more support plates 14 in various orientations with respect to forward direction 32. As has been indicted hereinbefore, support plates 14 may, in alternate embodiments, be moveable with respect to grate 6. As such, the quantity and orientations of support plates 14 as depicted in FIGS. 1–7 are intended to be used as examples, with other quantities and configurations being available in other embodiments to suit the particular application and the aesthetic tastes of the observer.

Firelog 4 is, in the preferred embodiments, a mixture of a particulate combustion material and an appropriate binder formed by a continuous extrusion process. The particulate combustion material may include sawdust, coal particles, or any of a variety of combustible materials. The binder material may be a paraffin or other appropriate material, preferably being combustible. Firelog 4 may additionally contain various types of additives intended to enhance burning or to produce colored flames or other desirable effects. Such artificial firelogs are well known and understood in the relevant art. Likewise, the process for making such firelogs is likewise known in the relevant art.

Firelog 4 is an elongated body of material of partial cylindrical section having a length 42 and a width 44. Firelog 4 contains a top end 46 and a bottom end 48 at opposite ends of its length 42, with both top and bottom ends 46 and 48 being substantially planar. In the preferred embodiments, top end 46 and bottom end 48 are parallel and spaced apart from one another, although other configurations are possible without departing from the spirit of the present invention.

Firelog 4 has a front surface 50 and a rear surface 52, both lying between top end 46 and bottom end 48. Front surface 50 is an arcuate surface extending between top end 46 and bottom end 48, and terminating at rear surface 52, although other shapes and configurations are possible without departing from the spirit of the present invention. In one such embodiment, front 50 and rear 52 surfaces may be connected by side surfaces.

In accordance with one of the features of the present invention, rear surface 52 contains a flat surface 54 which is divided by a channel 56 that defines a concave arcuate channel surface 58. Channel 56 and channel surface 58 are substantially parallel with length 42 of firelog 4, although deviations from parallel are possible depending upon the particular application and the relevant aesthetic considerations.

Figure 3:
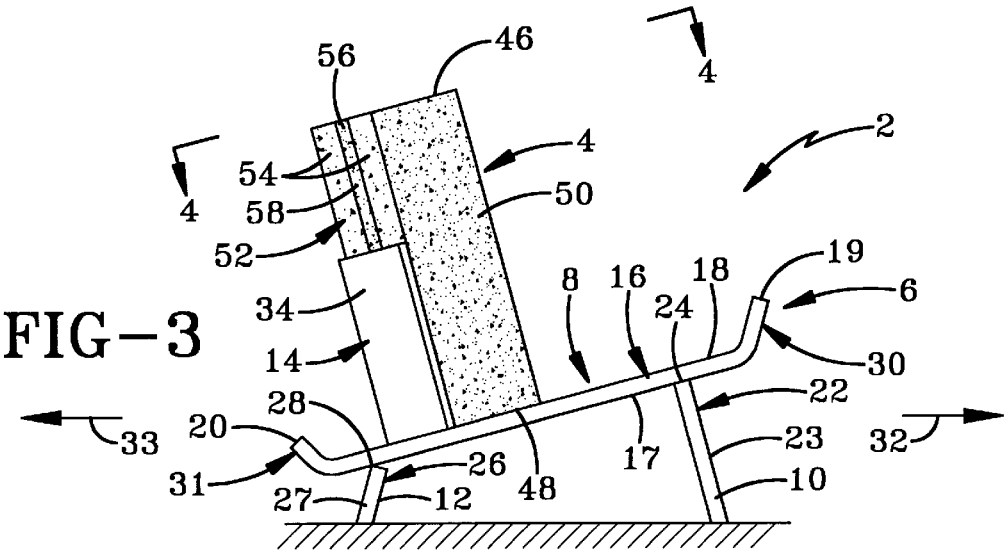
FIG. 3 is a left side elevation view of the first embodiment of the firelog and grate system of the present invention.

In accordance with the objectives of the present invention, firelog 4 rests on and is supported in a substantially upright orientation by support plate 14. As is shown in FIGS. 1–3, when firelog 4 is installed onto support plate 14, flat surface 54 of firelog 4 rests flush against forward surface 38 of support plate 14, and bottom end 48 of firelog 4 rests against upper surfaces 18 of bed bars 16. In accordance with the objectives of the present invention, it is preferred that channel surface 58 lies flush with curved surface 40 of rib 36, and as such, it is preferred that channel surface 58 be of a cooperative dimension and configuration with curved surface 40. Nevertheless, configurations in other embodiments are possible wherein channel surface 58 does not lie flush with curved surface 40 along the entire circumference and/or length thereof, and such configurations would not depart from the spirit of the present invention.

With firelog 4 installed on support plate 14, as is indicated in FIGS. 1–7, movement of firelog 4 is inhibited in the downward direction by bottom end 48 resting against upper surfaces 18 of bed bars 16. Additionally, movement in the forward and rearward directions 32 and 33 is limited by rear surface 52 of firelog 4 resting against support plate 14. As is best shown in FIG. 3, support plates 14 extend upwardly and are inclined in the rearward direction 33, thus supporting firelog 4 from falling in the rearward direction 33. Moreover, movement of firelog 4 in the left and right directions is limited by rib 36 which protrudes into channel 56, and by the preferred cooperation of curved surface 40 and channel surface 58.

As such, firelog 4 is carried by both support plate 14 and bed 8 and is securely held in place thereon by both gravity and friction. Inasmuch as the combustion of firelog 4 consumes it, firelog 4 may tend to collapse during combustion. Since firelog 4 is securely held in place by support plate 14 and bed 8, the likelihood that a burning firelog 4 will roll off grate 6 onto the floor is significantly diminished. Thus, the addition of support plate 14 dramatically increases the safety of system 2.

Inasmuch as rear surface 52 is substantially in contact with support plate 14, rear surface 52 is largely prevented from burning during combustion of firelog 4. This is due to the fact that support plate 14 inhibits oxygen in the air from contacting rear surface 52 in sufficient quantity for combustion thereof simultaneously with that of front surface 50. The combustion of firelog 4 on support plate 14 produces less heat than would firelog 4 if burned in the absence of support plate 14. Firelog 4 also burns longer when supported on plate 14 than when not supported on plate 14.

Inasmuch as multiple firelogs 4 can be burned simultaneously depending on the number of support plates 14 included with grate 6, the resulting fire may produce significant amounts of heat. Thus, it is preferred that firelogs 4 be of a size generally smaller than those prevalent in the industry, although this is by no means a requirement. Smaller firelogs 4 enable multiple firelogs 4 to be burned simultaneously without dramatically increasing the risk that the fireplace, damper assembly, and/or chimney would be damaged by the resulting increased heat.

System 2 thus meets all of the objectives enumerated above. System 2 provides a safe system for burning one or more firelogs in an aesthetically pleasing manner.

A second embodiment of the system of the present invention is indicated generally by the numeral 102, and is particularly shown in FIGS. 8–11. System 102 is similar to system 2 and thus similar numerals are used to identify similar elements. The configuration of grate 106 is similar to that of grate 6 except that front transverse bar 122 is substantially a mirror image of rear transverse bar 126. Bed bars 116 are fixedly attached to a top edge 124 of front transverse bar 122, and ends 123 and 127 form front legs 110 and rear legs 112, respectively, which extend in frontward and rearward directions 132 and 133, respectively, in comparable fashion. Thus, bed 108 of grate 106 is substantially horizontal and parallel with the ground.

System 102 includes at least one support pin 114 in place of support plates 14. Each support pin 114 is attached to at least a first bed bar 116 and extends generally upwardly therefrom. Each support pin 114 is an elongated body having an outer surface 140. In the preferred embodiment, support pin 114 is of a substantially circular cross-section. Nevertheless, support pin 114 could be of other cross-sections without departing from the spirit of the present invention.

System 102 includes a firelog 104 which is an elongated body of hollow substantially cylindrical section. Firelog 104 has a top end 146 and a bottom end 148 defining a length 142 therebetween. Firelog 104 includes an outer arcuate surface l5O between top end 146 and bottom end 148.

Firelog 104 is formed with a bore 156 configured to cooperate with support pin 114. Bore 156 defines an inner surface 158 on firelog 104.

Firelog 104 is installed on grate 106 by sliding inner surface 158 over outer surface 140 until bottom end 148 comes to a rest against bed 108. Inner surface 158 of firelog 104 cooperates with and rests against outer surface 140 of support pin 114, and bottom end 148 rests against bed 108. Thus, firelog 104 is prevented from movement in the downward direction by grate 106. Firelog 104 is prevented from movement in frontward and rearward directions 132 and 133 and the left and right directions by inner surface 158 resting against outer surface 140. Firelog 104 is, therefore, carried by both grate 106 and support pin 144 and is held in place thereon by both gravity and friction. In accordance with the objectives of the present invention, support pin 114 constitutes a support member for supporting firelog 104 thereon.

By positioning firelog 104 in a substantially upright orientation supported by support pin 114 on grate 106, system 102 provides as aesthetically pleasing fire in a safe manner. Inasmuch as arcuate surface 150 extends circumferentially around firelog 104, the burning of outer arcuate surface 150 can be viewed in all directions. System 102 is, therefore, especially useful with fireplaces located in the central portion of a room where such fireplaces typically have more than one open side from which the fire can be viewed. The sizes and or numbers of firelogs 104 can be varied to produce only as much heat as a typical fireplace can safely withstand.

As is indicated in FIGS. 8–11, system 102 may contain one or more support pins 114 and firelogs 104 in varying configurations, based upon the particular application and the relevant aesthetic qualities desired. Thus, configurations differing from those presented in FIGS. 8–11 are possible without departing from the spirit of the present invention.

Figure 12:
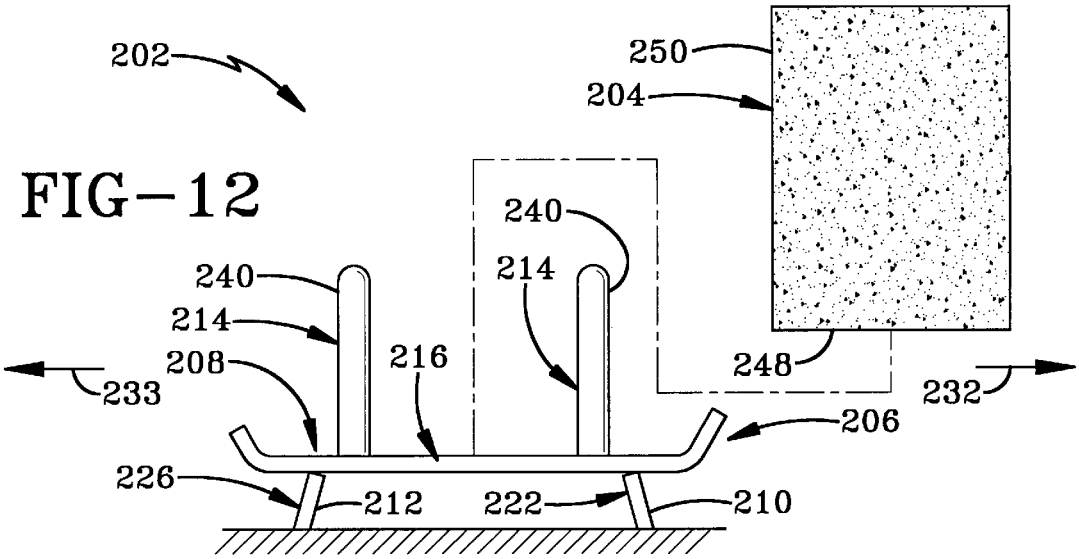
FIG. 12 is an exploded side elevational view of a third embodiment of the firelog and grate system of the present invention.
Figure 13:
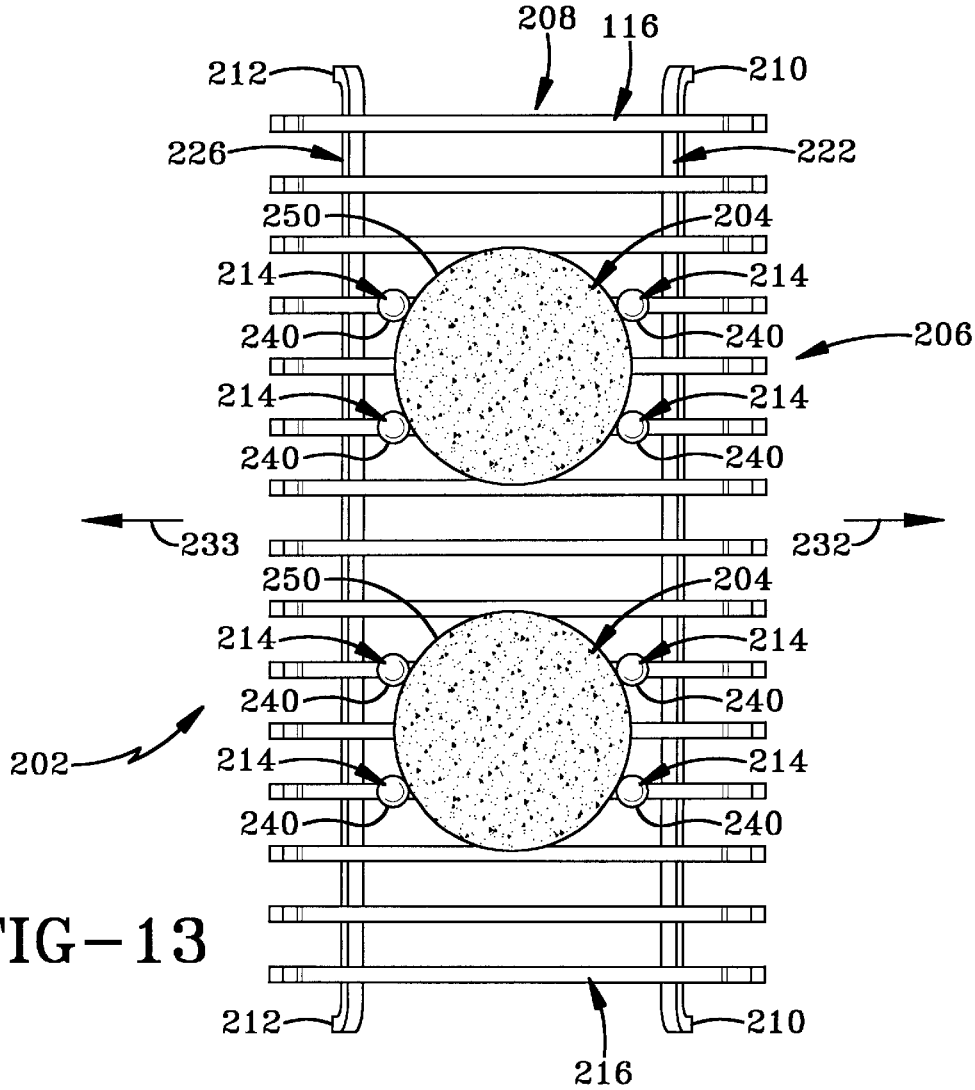
FIG. 13 is a plan view of the third embodiment of the firelog and grate system of the present invention.

A third embodiment of the firelog and grate system of the present invention is indicated generally by the numeral 202 in FIGS. 12–13. System 202 is similar to system 102 and similar numerals are used to indicate similar elements.

Grate 206 contains a plurality of support lugs 214 that cooperate to support a firelog 204. Support lugs 214 are fixedly attached to bed bars 216 and/or front transverse bar 222 and/or rear transverse bar 226 and extend generally upwardly therefrom. Support lugs 214 each contain an outer surface 240 and are configured such that outer surface 240 rests flush against outer arcuate surface 250 of firelog 204. Front legs 210 extend downwardly from bed 208 and generally in the frontward direction 232. Similarly, rear legs 212 extend downwardly from bed 208 and generally in the rearward direction 233. Bed 208 is substantially horizontal when grate 206 is placed onto a horizontal surface. The frontward extension of front legs 210 and the rearward extension of rear legs 212 add stability to grate 206.

As is indicated in FIG. 13, grate 206 contains at least four support lugs 214, although other configurations are possible without departing from the spirit of the present invention. For instance, a group of three support lugs 214 would serve to secure a single firelog 204 in frontward and rearward directions 232 and 233 and the left and right directions. Likewise, five or more support lugs 214 would serve the same purpose. In accordance with the objectives of the present invention, support lugs 214 constitute support members for supporting firelog 204 thereon.

As can be seen in FIGS. 12–13, firelog 204 is of a solid, approximately cylindrical section having no through bore. It should be understood that firelog 204 could contain a thru bore similar to bore 156 of firelog 104 or could by of a non-cylindrical section without departing from the spirit of the present invention.

Firelog 204 is installed onto grate 206 by sliding firelog 204 into the space between a group of support lugs 214 until bottom end 248 of firelog 204 rests against bed 208. In this position, surfaces 240 of support lugs 214 rest flush against outer arcuate surface 250 of firelog 204, thereby holding firelog 204 in a substantially upright position. Support lugs 214 are positioned to provide a snug fit between support lugs 214 and firelog 204. Moreover, it is preferred that the distance between surfaces 240 of adjacent support lugs 214 be less than the diameter of firelog 204 to prevent firelog 204 from tipping over after being placed between support lugs 214. Thus, firelog 204 is carried by both support lugs 214 and bed 208 and is supported thereon by both gravity and friction.

Inasmuch as outer arcuate surface 250 extends circumferentially about firelog 204, the combustion of firelog 204 can be observed in all directions, except where such view is obstructed by support lugs 214. System 202 is, therefore, especially useful in applications wherein the fireplace has two or more viewable sides. Firelogs 204 can, of course, be configured so that one or more can be burned without producing more heat than can be safely withstood by a typical fireplace.

Accordingly, the improved firelog and grate system device is simplified, provides an effective, safe, inexpensive, and efficient device which achieves all the enumerated objectives of the invention, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which improved firelog with grate system is constructed and used, the characteristics of the construction, and the advantageous new and useful results obtained; the new and useful structures, devices, elements, arrangements, parts, and combinations are set forth in the appended claims.

Having thus described the invention, it is claimed:

1. A fireplace grate for supporting in a position a firelog having a recessed feature, said grate comprising:

a bed; and at least a first support member connected to and extending up from said bed, wherein said first support member includes a substantially flat first surface and said first support member includes a second surface protruding from said first surface, whereby said second surface is receivable in the recessed feature of the firelog so as to support the firelog in said position.

2. The grate as defined in claim 1 wherein said first surface is tilted from vertical.

3. The grate as defined in claim 1 wherein said second surface is longitudinally and centrally disposed with respect to said first surface.

4. A fireplace grate for supporting a firelog, said grate comprising:

a bed;

at least a first support member connected to and extending up from said bed; said first support member including a substantially flat surface and including a second surface protruding from said flat surface; said second surface being longitudinally and centrally disposed with respect to said flat surface; and said second surface being arcuate.

5. The grate as defined in claim 4 further including at least a first front leg and at least a first rear leg attached to and extending substantially down from said bed.

6. The grate as defined in claim 5 wherein said bed is tilted from horizontal when said grate is placed on a substantially horizontal surface.

7. The grate as defined in claim 6 wherein said first front leg is longer than said first rear leg.

8. The grate as defined in claim 1 wherein said first support member is adapted to cooperate with and at least partially support the firelog.

9. The grate as defined in claim 8 wherein said first support member is an elongated body having an outer surface, said outer surface being adapted to cooperate with and at least partially support the firelog.

10. The grate as defined in claim 8 further comprising an additional support member; each of said support members being an elongated body having an outer surface, said outer surfaces being adapted to cooperate with and at least partially support the firelog.

11. The grate as defined in claim 1 in which the first support member is an upstanding post adapted for extending adjacent a firelog.

12. A fireplace grate for supporting a firelog, said grate comprising:

a bed;

at least a first support member connected to and extending up from said bed; said first support member being an upstanding post adapted for extending adjacent a firelog; wherein the upstanding post is adapted to extend through the center of a firelog.

13. The grate as defined in claim 11 in which a plurality of upstanding posts extend upwardly from the bed and are adapted to be positioned adjacent a firelog.

14. A combustible firelog adapted to be carried by at least a first support member of a fireplace grate, said firelog comprising:

an elongated body formed of a particulate material and a binder material;

said body having a length and at least a first support surface;

said first support surface including a substantially flat surface;

said first support surface adapted to be carried by the support member with said length of said body being oriented substantially upright; wherein the support surface is formed with a channel, and in which the channel surface is arcuate, and in which said first support surface is adapted to cooperate with the support member of the fireplace grate.

15. In combination, a grate and a combustible firelog;

said grate comprising a bed and at least a first support member connected to said bed;

said firelog comprising an elongated body formed of a particulate material and a binder material and having a length and at least a first support surface;

said first support surface of said body cooperating with and at least partially carried by said first support member; and said length of said body being oriented substantially upright.

16. The combination as defined in claim 15 wherein said first support member includes a substantially flat first surface.

17. The combination as defined in claim 16 wherein said first surface is tilted rearward from vertical.

18. The combination as defined in claim 17 wherein said first support member further includes and a second surface protruding from said first surface.

19. The combination as defined in claim 18 wherein said second surface is arcuate.

20. The combination as defined in claim 15 wherein said firelog is formed with a bore therein with said channel forming said first support surface, and wherein said first support member is an elongated body having an outer surface, said elongated body being received in said channel with said outer surface cooperating with said first support surface to at least partially support said firelog.

21. The combination as defined in claim 15 further comprising an additional support member; each of said support members being an elongated body having an outer surface, said firelog being received between said outer surfaces, and said outer surfaces of said support members at least partially supporting said firelog substantially upright by preventing said firelog from tipping.

22. The combination as defined in claim 20 comprising at least three support members, each of said support members being an elongated body having an outer surface, said firelog being received between said outer surfaces, said outer surfaces of said support members at least partially supporting said firelog substantially upright by preventing said firelog from tipping.

23. The combination as defined in claim 20 comprising at least four support members, each of said support members being an elongated body having an outer surface, said firelog being received between said outer surfaces, said outer surfaces of said support members at least partially supporting said firelog substantially upright by preventing said firelog from tipping.

24. The grate as defined in claim 1 wherein the recessed feature of the firelog is concave.

25. The grate as defined in claim 1 wherein the second surface is arcuate.

26. A fireplace grate for supporting in a position a firelog having a retaining feature, said grate comprising:

a bed;

at least a first support member connected to and extending from said bed;

said first support member including a substantially flat first surface;

said first support member including a second surface adjacent said flat surface, whereby said second surface is engageable with the retention feature of the firelog so as to support the firelog in the position;

said second surface protruding from said flat surface;

said second surface being longitudinally and centrally disposed with respect to said flat surface; and said second surface being arcuate.

27. The grate as defined in claim 26 further including at least a first front leg and at least a first rear leg attached to and extending substantially down from said bed.

28. The grate as defined in claim 27 wherein said bed is tilted from horizontal when said grate is placed on a substantially horizontal surface.

29. The grate as defined in claim 28 wherein said first front leg is longer than said first rear leg.

* * * * *